US006508282B2

(12) United States Patent
Garofalo et al.

(10) Patent No.: US 6,508,282 B2
(45) Date of Patent: Jan. 21, 2003

(54) COVER FOR PROPANE TANK

(76) Inventors: Santo G. Garofalo, 417 Florence St., Mamaroneck, NY (US) 10543; Sandra L. Garofalo, 417 Florence St., Mamaroneck, NY (US) 10543; John D. Zoidis, 40 Birchwood Dr., Fairfield, CT (US) 06430

( * ) Notice: Subject to any disclaimer, the term of this patent is extended or adjusted under 35 U.S.C. 154(b) by 0 days.

(21) Appl. No.: 09/880,314

(22) Filed: Jun. 13, 2001

(65) Prior Publication Data

US 2002/0189730 A1 Dec. 19, 2002

(51) Int. Cl.[7] ..... B65D 65/02
(52) U.S. Cl. ..... 150/154; 220/581
(58) Field of Search ..... 150/154, 901; 220/581, 582; 224/401, 408

(56) References Cited

U.S. PATENT DOCUMENTS 1,068,066 A * 7/1913 Martin ..... 150/154
1,395,485 A * 11/1921 Duncan et al. ..... 150/154 X
3,766,954 A * 10/1973 Gentellalli ..... 150/154
4,964,930 A * 10/1990 Conn ..... 156/85
5,356,046 A * 10/1994 Burke ..... 150/154 X
5,685,977 A * 11/1997 Golston et al. ..... 150/154 X
5,984,172 A * 11/1999 Easterwood ..... 150/154 X
6,006,743 A * 12/1999 Shimek et al. ..... 126/512
6,012,411 A * 1/2000 Hochbrueckner ..... 150/154 X
6,102,230 A * 8/2000 Gould ..... 220/913 X
6,123,187 A * 9/2000 Bartels ..... 206/459.1 X
6,142,192 A * 11/2000 Dickinson et al. ..... 150/154 X

* cited by examiner

*Primary Examiner*—Sue A. Weaver

(57) ABSTRACT

A cover for propane tank comprises an open top portion for enveloping the neck portion of the tank and a skirt portion for enveloping the cylindrical body of the tank. The skirt portion is generally rectangular when laid out flat and has opposed parallel longitudinal edges and opposed parallel lateral edges. Each of the lateral edges has a Velcro® strip which together form a closure strip to envelope the body of the tank, and a gathering ribbon at the bottom of the skirt portion, said gathering ribbon having end portions which can be tied together in the form of a bow to completely cover and envelope the cylindrical body of the tank.

8 Claims, 2 Drawing Sheets

COVER FOR PROPANE TANK

FIELD OF THE INVENTION

The present invention relates to tank covers and is particularly related to a decorative as well as functional covers for propane tanks as well as other gas or liquid-containing tanks.

BACKGROUND OF THE INVENTION

A variety of tank covers are commonly used for gas or liquid-containing tanks such as propane tank. These covers may be made of fabric or flexible plastic film and are usually made to conform to the shape of the tank. Some covers are used for thermal insulation purpose, others as cooling jackets and still others for protection against the elements. One early patent, i.e., U.S. Pat. No. 2,426,475 discloses a cooling jacket for milk cans, the jacket being made of a semi-porous and absorbent fibrous and flexible material. A more recent patent, i.e., U.S. Pat. No. 6,012,411 issued Jan. 11, 2000 describes a propane tank cover having an open bottom for lacing it over the top of the tank, and an upper portion with a central aperture for allowing the tank valve to pass therethrough. The cover is preferably made of a plastic film such as polyvinyl chloride film, but may also be formed of paper or other plastic films. The tank cover described in said patent and the several patents mentioned therein are generally intended for use as thermal insulators or for use in systems designed for estimating the gas or liquid content of the tank. As evidenced from the prior art patents, most if not all tank covers, especially propane tank covers, have heretofore been designed with a view toward one or more functional aspects of the container with little or no attention to the appearances and aesthetic features of the cover. Consequently, propane tanks, or other covered tanks for that matter, are usually hidden from view because of their generally unattractive appearance.

Therefore, it is an object of the present invention to provide a cover for tanks and similar containers which are not only functional for covering the tanks, but which are also attractive and have aesthetically pleasing appearance.

It is a further object of the present invention to provide a functional as well as aesthetically pleasing covers for propane tanks.

The foregoing and other features of the present invention will be more fully understood from the following detailed description of the invention in conjunction with the accompanying drawings.

SUMMARY OF THE INVENTION

The present invention provides a cover for propane tank although the cover described herein may be generally used for other similar tanks, both as protective cover as well as for its aesthetic appearance. The cover comprises an open top portion, which is preferably elasticated, to envelope the bottom or lower end of the neck of the propane tank, and a skirt portion which may be formed integrally with the neck portion. The skirt portion usually has a rectangular configuration when viewed in laid out position and assumes a flared bottom shape, generally truncated, when the cover envelopes the cylindrical body of the propane tank. The skirt portion, when viewed flat, has two opposed parallel longitudinal edges and two opposed parallel lateral edges with each lateral edge comprising a strip having an adhesive-covered surface, or Velcro®, in facing relation to each other so as to form a closure strip for enveloping the tank. The flared bottom end of the skirt portion is folded inwardly and is sewn to form a circumferential channel through which a gathering ribbon is passed, the ends of which extend beyond the longitudinal edges of the channel. The ends of the gathering ribbon may be tied together as a bow in order to completely enclose the cylindrical body of the tank.

BRIEF DESCRIPTION OF THE DRAWINGS

In the drawings, wherein like reference numerals designate like parts.

DETAILED DESCRIPTION OF THE INVENTION

Figure 1:
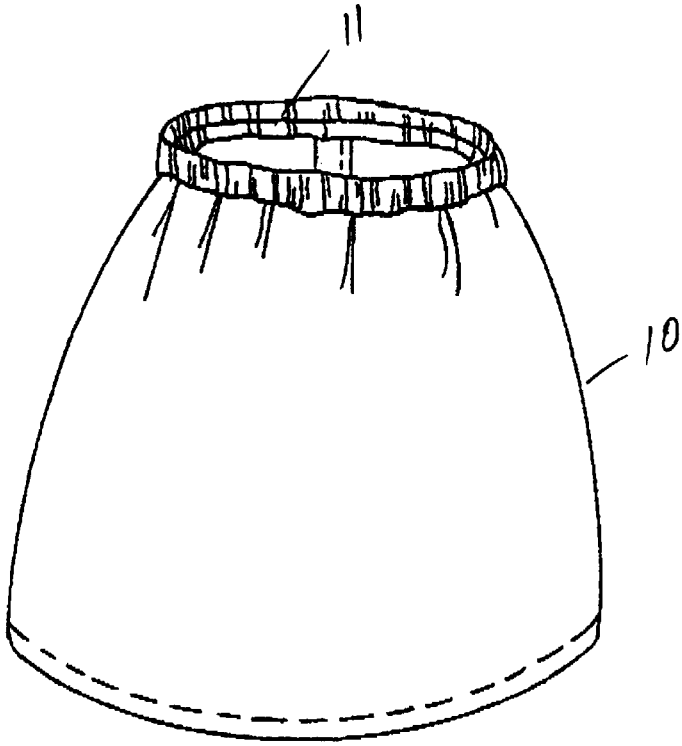
FIG. 1 is a vertical front view, partly in perspective, showing the tank cover of the present invention.
Figure 2:
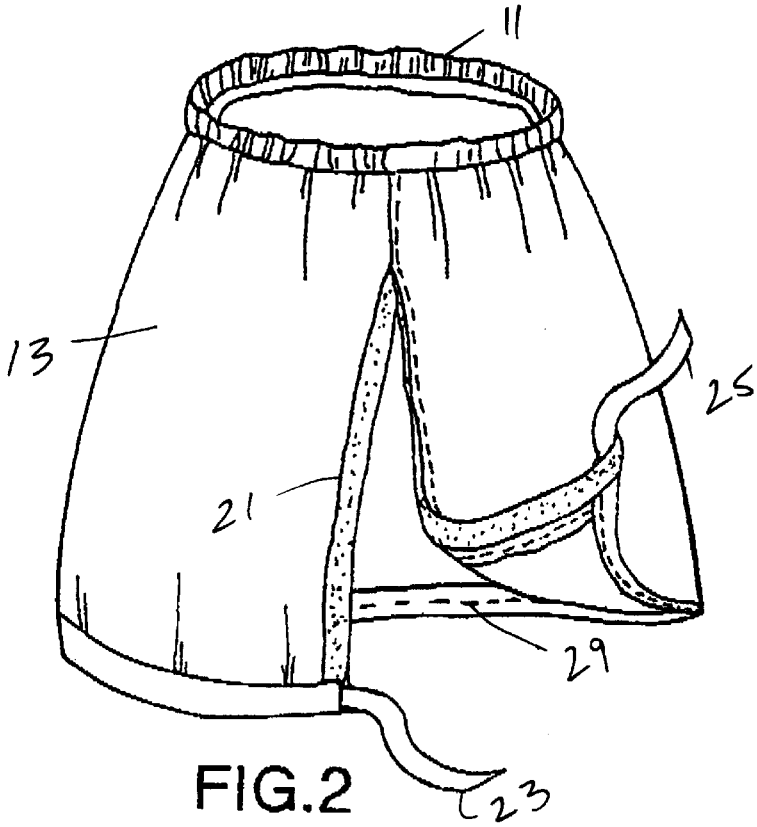
FIG. 2 is a vertical back view, partly open and partly in perspective, showing the tank cover of the present invention.
Figure 3:
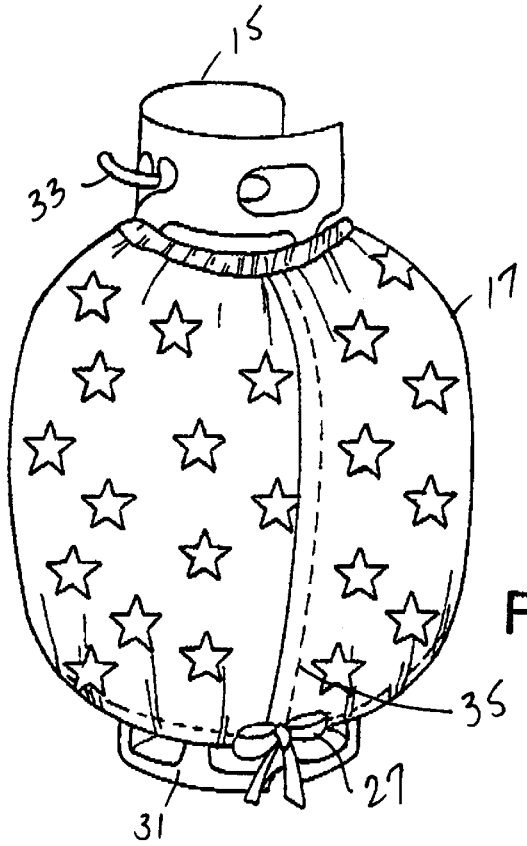
FIG. 3 is a perspective view of a typical propane tank with the tank cover of the present invention slipped thereon, wherein the tank cover has decorative stars printed thereon for aesthetic purpose.
Figure 4:
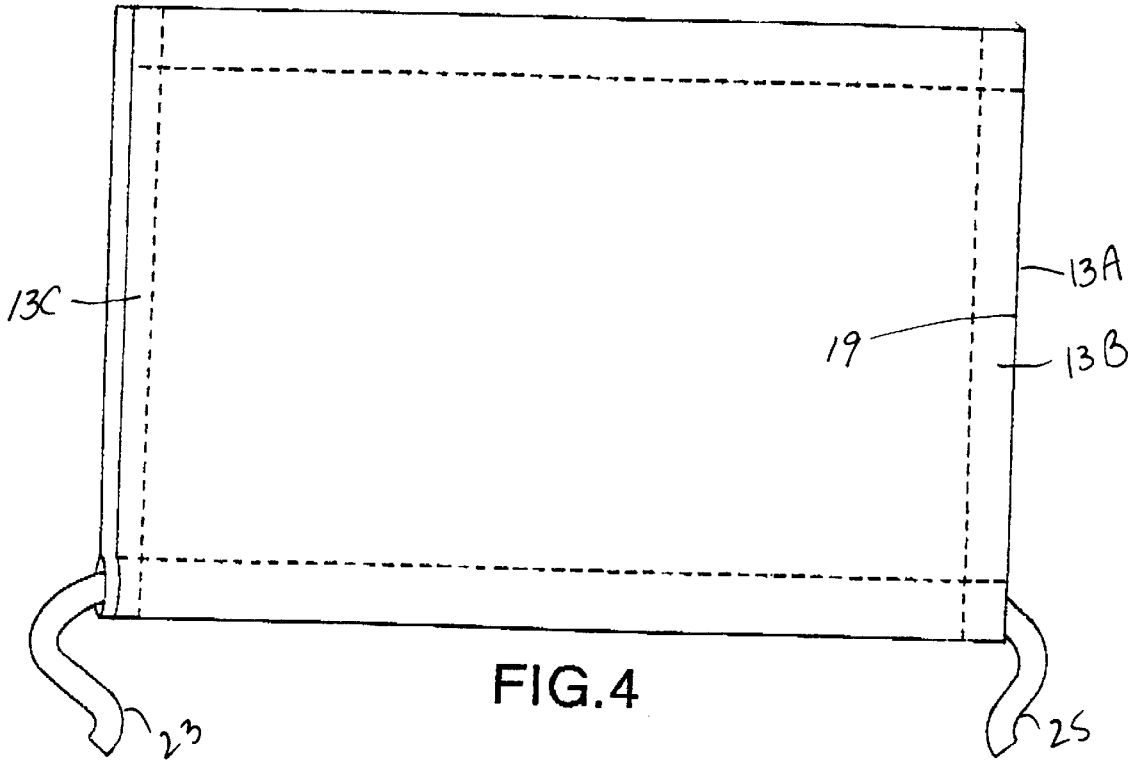
FIG. 4 is a plan view of the inside of the tank cover shown in FIGS. 1 and 2, when laid out flat.

Referring first to FIGS. 1 and 2, the tank cover generally designated as 10 has, during use, a generally truncated configuration having an elasticated neck or open top portion 11 and a continuous skirt portion 13 such that when the top portion 11 is slipped over the mouth 15 of the tank 17, the skirt 13 completely drapes over the tank body as shown in FIG. 4. Accordingly, and as shown in plan view in FIG. 4, the tank cover is sized so as to completely envelop the tank body. As it can be appreciated, the size of the cover may vary to accommodate the different size tanks which are in general use. Also, in lieu of an elasticated neck, the top portion may be an open top provided with zipper or some other closure means to conformally fit tightly around the bottom of the mouth of the container.

Referring to FIGS. 24, the lateral edge 13A of the skirt portion 13 may be seamed to form a strip 13B to which is sewn an elongated Velcro® strip 19 running from the bottom of the neck portion 11 down to the flared bottom end of the skirt portion 13. At its opposed lateral edge 13C, on its outer surface, the skirt portion 13 is provided with a strip 22 on which is sewn a Velcro® strip 21 which also runs down from the bottom of the neck portion 11 toward the flared bottom end of the skirt portion 13. The lower end of the Velcro® strip 21 terminates slightly higher, usually about ½ to 1 inch, relative to the lower terminal end of the Velcro® strip 19. The flared bottom end of the skirt 13 is partly folded inwardly, a height of about ½ to about 1 inch, to form a circumferential channel through which is gathering ribbon is passed. The gathering ribbon has end portions 23 and 25 which may be tied together in the form of a bow 27 adjacent the skirt hemmed portion 29 above the tank bottom support base 31. The skirt portion 13 is closed by the Velcro® strip closures 19 and 21 thus completely enveloping the tank body with the tank cover.

A variety of fabrics or plastic films may be used for fabricating a tank cover according to the present invention. When using a plastic film it is naturally desirable to use a flexible film which can be adapted to conform to the tank shape. The plastic film may be clear or opaque and preferably it has a print receptive surface for printing various designs. Similarly, when a fabric is used to form the tank cover, the fabric may have a printed surface for decorative purpose. The tank cover shown in FIG. 4, for example, has a printed star surface although it may be any other printed design. It must be understood, however, that the provision of various designs on the cover surface is strictly for cosmetic purpose and is not, per se, a required feature of the present invention.

In use, usually when storing the propane tank, the elasticated neck portion 11 is fitted snugly around the bottom of the mouth 15, below the handle 33, and the skirt portion 13 is then draped over the tank body with the Velcro® strips 19,21 apart (see FIG. 2). The Velcro® strips 19,21 are then closed to provide a Velcro® closure strip 35 which runs from the bottom of neck portion 15 to the skirt hemmed bottom 29 and the ends 23 and 25 of the gathering ribbons are then tied in the form of a bow 27, as shown in FIG. 4.

As it may be appreciated from the foregoing description, some obvious changes and modifications may be made in the construction of the tank cover. For example, in lieu of using a Velcro® covered strip, each strip surface may be covered by a suitable adhesive which can be removably bonded to each other. Such changes are nevertheless within the scope of the present invention. As a second example, a gathering cord may be used instead of a gathering ribbon through the circumferential channel at the flared bottom end of the skirt portion, the ends of which may be cinched or fastened.

What is claimed is:

1. A cover for propane tank having a neck portion and a generally cylindrical body, said cover comprising an open-top portion adapted to envelope the bottom of the neck portion of said tank, and a skirt portion formed integrally with said open top portion, said skirt portion adapted to conformally envelope said tank when the cylindrical body of said tank is covered by said cover, said skirt portion having opposed generally parallel longitudinal edges and opposed generally parallel lateral edges with each of said lateral edges having a strip with releasable adherent surface extending from about said open top portion to the bottom of said skirt portion and wherein said adherent surfaces are in facing relative to each other so as to define a closure strip thereby completely enveloping the body of said tank.

2. A cover as in claim 1 wherein said open-top portion is elasticated.

3. A cover as in claim 1 further including a gathering ribbon around the bottom of said skirt portion, said gathering ribbon having end portions adapted to be tied together in the general form of a bow.

4. A cover as in claim 2 further including a gathering ribbon around the bottom of said skirt portion, said gathering ribbon having end portions adapted to be tied together in the general form of a bow.

5. A cover as in claim 1 wherein each of said releasable adherent surfaces is a Velcro® covered surface.

6. A cover as in claim 2 wherein each of said releasable adherent surfaces is a Velcro® covered surface.

7. A cover as in claim 3 wherein each of said releasable adherent surfaces is a Velcro® covered surface.

8. A cover as in claim 4 wherein each of said releasable adherent surfaces is a Velcro® covered surface.

* * * * *